US011434573B2

(12) United States Patent
Mohr

(10) Patent No.: US 11,434,573 B2
(45) Date of Patent: Sep. 6, 2022

(54) BORIC ACID-FREE COMPOSITION FOR REMOVING DEPOSITS CONTAINING CRYOLITE

(71) Applicant: Chemetall GmbH, Frankfurt (DE)

(72) Inventor: Anna Verena Mohr, Frankfurt am Main (DE)

(73) Assignee: Chemetall GmbH, Frankfurt (DE)

( * ) Notice: Subject to any disclaimer, the term of this patent is extended or adjusted under 35 U.S.C. 154(b) by 8 days.

(21) Appl. No.: 16/769,966

(22) PCT Filed: Dec. 7, 2018

(86) PCT No.: PCT/EP2018/084005
§ 371 (c)(1),
(2) Date: Jun. 4, 2020

(87) PCT Pub. No.: WO2019/115395
PCT Pub. Date: Jun. 20, 2019

(65) Prior Publication Data

US 2020/0385872 A1 Dec. 10, 2020

(30) Foreign Application Priority Data

Dec. 12, 2017 (EP) ..... 17206616

(51) Int. Cl.

| | |
|---|---|
| ***C11D 7/08*** | (2006.01) |
| ***C23G 1/02*** | (2006.01) |
| ***B08B 3/08*** | (2006.01) |
| ***C11D 3/04*** | (2006.01) |
| ***C11D 3/20*** | (2006.01) |

(52) U.S. Cl.
CPC ..... *C23G 1/02* (2013.01); *B08B 3/08* (2013.01); *C11D 3/042* (2013.01); *C11D 3/2082* (2013.01); *B08B 2203/007* (2013.01)

(58) Field of Classification Search
CPC ..... C11D 3/2075; C11D 11/0023; C11D 11/0029
USPC ..... 510/218
See application file for complete search history.

(56) References Cited

U.S. PATENT DOCUMENTS

| | | | | |
|---|---|---|---|---|
| 2,411,807 | A * | 11/1946 | Riesmeyer | C01F 7/46 423/132 |
| 7,531,051 | B2 * | 5/2009 | Nakayama | C23C 22/34 148/247 |
| 2004/0129295 | A1 * | 7/2004 | Lovetro | C01B 15/037 134/3 |
| 2006/0270573 | A1 * | 11/2006 | Ikemoto | H01L 21/3212 510/175 |
| 2007/0272900 | A1 * | 11/2007 | Yoshida | C23C 22/34 252/387 |
| 2010/0144581 | A1 * | 6/2010 | Nekmard | C11D 3/2075 510/405 |
| 2019/0112717 | A1 | 4/2019 | Mohr | |
| 2021/0032573 | A1 * | 2/2021 | Marquard | B08B 3/08 |

FOREIGN PATENT DOCUMENTS

| | | | |
|---|---|---|---|
| CN | 105441955 | A | 3/2016 |
| DE | 4128107 | A1 | 2/1993 |
| DE | 102006011875 | A1 | 9/2007 |
| WO | 2017186931 | A1 | 11/2017 |
| WO | 2017202891 | A1 | 11/2017 |

OTHER PUBLICATIONS

International Search Report for corresponding PCT/EP2018/084005 dated Mar. 4, 2019, 2 pages.
European Search Report for EP Patent Application No. 17206616.9, dated Jun. 7, 2018, 3 pages.

* cited by examiner

*Primary Examiner* — Gregory E Webb
(74) *Attorney, Agent, or Firm* — Armstrong Teasdale LLP

(57) ABSTRACT

Described herein is an aqueous composition for removing cryolitic deposits from plants or parts of plants which serve for the conversion treatment of metal surfaces, said composition including a) at least one mineral acid, and b) at least one dicarboxylic acid of the formula HOOC—$(CH_2)_x$—COOH, where x is 0 to 3 and no borate-containing compounds have been added to the composition. Also described herein is a corresponding method for removing cryolitic deposits.

20 Claims, No Drawings

BORIC ACID-FREE COMPOSITION FOR REMOVING DEPOSITS CONTAINING CRYOLITE

CROSS-REFERENCE TO RELATED APPLICATIONS

This application is a U.S. National Phase Application of PCT/EP2018/084005, filed Dec. 7, 2018, which claims the benefit of priority to European Patent Application No. 17206616.9, filed Dec. 12, 2017, the entire contents of which are hereby incorporated by reference herein.

The invention relates to a composition and also to a method for removing cryolitic deposits from plants or parts of plants which serve for the conversion treatment of metal surfaces.

It is known practice to apply conversion coats to metal surfaces of aluminum and steel, including galvanized steel, for example, as a suitable surface-coating base for a subsequent organic coating. The solutions employed for these purposes may comprise in the case of phosphating solutions e.g., zinc and phosphate ions and also ions of nickel, manganese, magnesium, calcium, copper, cobalt, alkali metals and/or ammonium.

Also commonplace is the presence of accelerating adjuvants such as nitrite, chlorate, peroxide or combinations thereof, of anions such as chloride and sulfate for preserving electroneutrality, and, optionally, of coat-refining adjuvants such as hydroxycarboxylic acids, aminocarboxylic acids or condensed phosphates, and also of complex or simple fluorides.

Also serving for the treatment of, in particular, aluminum and zinc, furthermore, are treatment solutions containing fluoride and optionally nitrate and/or phosphate. Also common in the case of the treatment of aluminum are solutions which contain titanium and/or zirconium ions, fluoride ions, and optionally tannin.

To the extent the aforesaid solutions are used for treating metal surfaces consisting wholly or partly of aluminum or its alloys, ions of aluminum enter the solution and, by sodium ions and fluoride ions that are present in the bath solution, are precipitated according to the reaction equation $$3Na^{+}(aq)+Al^{3+}(aq)+6F^{-}(aq)\rightarrow Na_3AlF_6(s)\downarrow$$

in the form of cryolite, which has a very low solubility. In this case, a part of the precipitated cryolite remains suspended in the bath solution or falls as a pumpable and flowable precipitate to the bottom of the bath container. A further part grows in the form of a very firmly adhering crust on the walls of the bath containers and also in the interior of lines, pumps, heat exchangers, nozzle assemblies, and spraying nozzles, and adversely affects the functioning of the plant. At regular intervals of time, therefore, the deposits have to be removed mechanically or chemically, chemically at locations where accessibility is restricted.

The chemical removal of deposits in plants or parts of plants is carried out using depending on the construction material employed solvents based on sulfuric acid, amidosulfuric acid, hydrochloric acid, nitric acid, or sodium hydroxide/complexing agents. These are suitable for removing crusts consisting of zinc phosphates and iron phosphates, of the kind arising in the phosphating of steel, including galvanized steel.

Where, conversely, the deposits in question consist to a large extent of very sparingly soluble cryolite, a difficulty which arises is that the aforesaid solvents are very slow to attack and, moreover, are able to dissolve only a small amount of crusts. This means that maintenance times are undesirably long and that the levels of chemical consumption are disproportionately high.

For removing cryolitic deposits, DE 41 28 107 A1 teaches the contacting of the plants or parts of plants with a solution comprising a mineral acid and a borate-containing compound.

Since then, however, the use of borate-containing compounds such as boric acid is to be avoided as and when possible, for reasons of environmental protection and also toxicology. In the near future, boric acid might no longer be available at all, because of the REACH regulation. At least, the availability of boric acid will decline more and more in the forthcoming years, for the reasons stated.

It is an object of the invention to provide a composition and also a method for removing cryolitic deposits from plants or parts of plants which serve for the conversion treatment of metal surfaces, said composition and method no longer having the disadvantages of the known compositions or methods, respectively, and permitting in particular a less time-consuming, economical cleaning process while also operating substantially, more particularly entirely, without the use of borate-containing compounds.

Moreover, the time needed for the complete breakdown/dispersal of the cryolitic deposits (dissolving time) and also the quantity of cryolitic deposits dissolved per unit amount of solvent are to be comparable to those achieved by the combination of mineral acid and borate-containing compound.

The object is achieved, firstly, by a method of the invention for removing cryolitic deposits from plants or parts of plants, which comprises contacting the plants or parts of plants with an aqueous composition which comprises a) at least one mineral acid and b) at least one dicarboxylic acid of formula HOOC—$(CH_2)_x$—COOH where x is 0 to 3 and no borate-containing compounds have been added to the composition.

Whereas the at least one mineral acid contributes with its high acidity to breaking down cryolitic deposits, the effect of the at least one dicarboxylic acid in this respect is attributable to it being an effective complexing agent for $Al^{3+}$, and, by complexing, removing these ions from the solubility equilibrium of cryolite.

Definitions

The term "cryolitic deposits" refers presently to solid deposits, i.e., crusts, which consist to an extent of preferably more than 50 wt % and more preferably more than 90 wt % of cryolite (dry weight).

"Removing cryolitic deposits" is intended to be understood not only as the detachment of said deposits from the corresponding plants or parts of plants but also, furthermore, the dissolution and/or dispersal of at least 90 wt %, and more particularly the complete dissolution/dispersal of the deposits.

An "aqueous composition" is intended presently to be understood as a composition which comprises predominantly, i.e., to an extent of more than 50 wt %, of water as solvent or dispersion medium. The aqueous composition is preferably a solution, more preferably a solution containing only water as its solvent.

The statement that "no borate-containing compounds have been added to the composition" is not intended to rule out the possible presence in the composition of a negligible proportion of borate-containing compounds, which in that case are attributable to contamination of the raw materials used. By "borate-containing compounds" are meant, in particular, borax and boric acid.

The "normal concentration" of an acid is synonymous with the molar concentration of the protons releasable from the acid. In the case of sulfuric acid, for instance, two protons are released per molecule of acid. Consequently, a sulfuric acid having a molar concentration of 1 mol/l has a normal concentration of 2 mol/l.

The at least one dicarboxylic acid may also have been added to the solution as a salt, in other words to the aqueous composition as dicarboxylate or monohydrogen dicarboxylate.

According to one preferred embodiment, the plants and/or parts of plants are contacted with an aqueous composition which comprises a) at least one mineral acid having a normal concentration (total) in the range from 1.0 to 10 mol/l, and b) at least one dicarboxylic acid of the formula HOOC—$(CH_2)_x$—COOH having a total concentration in the range from 0.07 to 1.7 mol/l, where x is 0 to 3 and no borate-containing compounds have been added to the composition.

This at least one mineral acid is present preferably in a normal concentration (total) in the range from 2.0 to 8.0 mol/l, more preferably from 3.0 to 6.0 mol/l, and very preferably from 3.5 to 4.5 mol/l, while the at least one dicarboxylic acid is present in a total concentration in the range from 0.07 to 1.5 mol/l, more preferably from 0.35 to 1.5 mol/l, very preferably from 0.35 to 1.0 mol/l, and especially preferably from 0.5 to 0.8 mol/l.

Likewise encompassed are all combinations of the aforesaid concentration ranges for the at least one mineral acid with the aforesaid concentration ranges for the at least one dicarboxylic acid.

The aqueous composition preferably comprises the at least one mineral acid and the at least one dicarboxylic acid in a molar ratio in the range from 2.4:1 to 60:1, more preferably from 2.6:1 to 60:1, more preferably from 2.6:1 to 12:1, very preferably from 4.0:1 to 12:1, and especially preferably from 5.0:1 to 8.0:1 (normal concentration (total) of the at least one mineral acid in mol/l relative to the total concentration of the at least one dicarboxylic acid in mol/l).

It is particularly advantageous for the plants or parts of plants to be contacted with an aqueous composition which as the at least one mineral acid comprises hydrochloric acid, sulfuric acid and/or nitric acid.

The at least one mineral acid is especially preferably sulfuric acid.

From a technical applications standpoint and on the basis of its functionality, sulfuric acid is advantageous over hydrochloric acid and nitric acid. Thus, with the use of hydrochloric acid, a problem is that the cryolitic deposits can only be dissolved slowly, because there is no possibility of heating the plant in order to accelerate the dissolution process. The vapors forming would otherwise corrode the plant. In the case of nitric acid, on the other hand, the risk is that nitrous gases might form through reaction with the phosphating residues.

The at least one dicarboxylic acid of the formula HOOC—$(CH_2)_x$—COOH may be glutaric acid (x=3), succinic acid (x=2), malonic acid (x=1) and/or oxalic acid (x=0).

Dicarboxylic acids with x>3 such even as adipic acid with x=4 have too low a solubility in the aqueous medium, conversely, and are therefore no longer able to act as complexing agents for $Al^{3+}$.

The at least one dicarboxylic acid is preferably malonic acid (x=1) and/or oxalic acid (x=0) and more preferably oxalic acid (x=0).

The aqueous composition advantageously further comprises at least one nonionic surfactant. The reason is that this facilitates the wetting of the cryolitic deposits with the aqueous composition. It is particularly advantageous in this case if the at least one nonionic surfactant is selected from the group consisting of ethoxylated fatty alcohol polyglycol ethers.

The aqueous composition may preferably further comprise at least one corrosion inhibitor, in order to protect the plants or parts of plants from corrosion during their contacting with the aqueous composition.

This at least one corrosion inhibitor preferably comprises at least one compound selected from the group consisting of urea derivatives and diols, including alkoxylated diols.

According to a first particularly preferred embodiment, the at least one corrosion inhibitor is N,N'-diethylthiourea or a mixture of N,N'-di(o-tolyl)thiourea, N,N'-dibutylthiourea, and hexamethylenetetramine.

According to a second particularly preferred embodiment, the at least one corrosion inhibitor is a mixture of a compound of the formula I $$R^1O—(CH_2)_x—C{\equiv}C—(CH_2)_y—OR^2 \quad (I),$$

in which $R^1$ and $R^2$ are both H, and a compound of the formula I in which Wand $R^2$ each independently of one another are an HO—$(CH_2)_w$ group with w≥2, preferably both are an HO—$CH_2)_2$ group, where for each of the two compounds of the formula I, x and y in each case independently of one another are 1 to 4. A mixture of this kind is less toxicologically objectionable and also less environmentally harmful than the aforesaid urea derivatives.

It is particularly advantageous if the method of the above-specified type, in accordance with the invention, is configured in such a way that the plants and/or parts of plants are contacted with an aqueous composition which comprises a) sulfuric acid having a normal concentration (total) in the range from 1.0 to 10 mol/l, and b) oxalic acid having a total concentration in the range from 0.07 to 1.7 mol/l, where no borate-containing compounds have been added to the composition.

This sulfuric acid is present preferably in a normal concentration (total) in the range from 2.0 to 8.0 mol/l, more preferably from 3.0 to 6.0 mol/l, and very preferably from 3.5 to 4.5 mol/l, while oxalic acid is present in a total concentration in the range from 0.07 to 1.5 mol/l, more preferably from 0.35 to 1.5 mol/l, very preferably from 0.35 to 1.0 mol/l, and especially preferably from 0.5 to 0.8 mol/l.

Likewise encompassed are all combinations of the aforesaid concentration ranges for the sulfuric acid with the aforesaid concentration ranges for the oxalic acid.

The aqueous composition preferably comprises the sulfuric acid and the oxalic acid in a molar ratio in the range from 2.4:1 to 60:1, more preferably from 2.6:1 to 60:1, more preferably from 2.6:1 to 12:1, very preferably from 4.0:1 to 12:1, and especially preferably from 5.0:1 to 8.0:1 (normal concentration (total) of the sulfuric acid in mol/l relative to the total concentration of the oxalic acid in mol/l).

In the case of sulfuric acid as the at least one mineral acid used, the plants or parts of plants are contacted in accordance with one advantageous embodiment of the invention with an aqueous composition which additionally comprises nitrate. The presence of nitrate in an aqueous composition with sulfuric acid ensures the passivation of plants or parts of plants made from stainless steels.

In the treatment of plants and/or parts of plants with an aqueous composition comprising sulfuric acid and oxalic acid and nitrate, particularly favorable results are achieved if said plants and/or parts of plants are contacted, in accordance with another advantageous embodiment of the invention, with an aqueous composition in which the weight ratio of sulfuric acid (calculated as $H_2SO_4$) to nitrate (calculated as $NO_3^-$) is 5:1 to 50:1, preferably 15:1 to 25:1.

The plants to be freed from cryolitic deposits may for example be spray phosphating plants or immersion phosphating plants.

A plant to be freed from cryolitic deposits is preferably contacted with the aqueous composition by admitting this composition into the plant to a height such that all parts of the plant bearing cryolitic deposits are covered with the aqueous composition.

Alternatively, parts of the plant that are affected may also be uninstalled and placed into a corresponding treatment bath of the aqueous composition, so that all of the parts of the plant are covered with the aqueous composition.

To accelerate the dissolution of cryolitic deposits, it is advantageous in this case if the aqueous composition is stirred while in contact with the corresponding plant or corresponding parts of plants.

Alternatively, the aqueous composition can with particular advantage be circulated through the plant tanks, pipes, nozzles, etc.

The temperature at which the aqueous composition is employed may in principle be between room temperature and around 95° C. Particularly advantageous, however, is a temperature in the range from 40 to 80° C., more particularly from 50 to 70° C., since here the dissolution of the cryolitic deposits is particularly quick, but without having to suffer a fairly high energy consumption. The desired temperature may be established, for example, by heating the corresponding plant and/or the corresponding treatment bath.

If the aqueous composition is circulated through the plant, the time for the removal, more particularly the time for complete dissolution/dispersal (dissolving time) of all the cryolitic deposits, is preferably between 2 and 6 hours.

The amount of cryolitic deposits dissolved per 100 g of the aqueous composition is preferably at least 4 g, more preferably at least 5 g.

In that case, preferably, there is little sediment formed when the aqueous composition is cooled, especially to room temperature. This makes it easier for the aqueous composition to be recycled after having been pumped off from the plant or parts of plants.

In addition to its application to plants or parts of plants made from acid-resistant metallic materials, the composition/method of the invention is also particularly suitable for those made of plastic.

The object is achieved, secondly, by an aqueous composition for removing cryolitic deposits from plants or parts of plants which serve for the conversion treatment of metal surfaces, said composition comprising a) at least one mineral acid and b) at least one dicarboxylic acid of formula HOOC—$(CH_2)_x$—COOH where x is 0 to 3 and no borate-containing compounds have been added to the composition.

Advantageous configurations of this composition of the invention have already been elucidated above in connection with the method of the invention.

The present invention relates, moreover, to a concentrate from which, by dilution with a suitable solvent and/or dispersion medium, preferably with water, an aqueous composition of the invention is obtainable.

The composition/method of the invention is elucidated in more detail by the examples which follow, which should not be understood as imposing any restriction.

EXAMPLES

In a spray phosphating plant for the treatment of metal surfaces which consist of 80 wt % of aluminum, 15 wt % of galvanized steel, and 5 wt % of steel, sparingly soluble deposits are observed in the nozzle assemblies, the composition of these deposits being as follows (all figures in wt %):

30.3% Na
12.4% Al
52.3% F
1.2% Zn
1.8% Fe
0.2% Mn
1.8% $P_2O_5$

The deposits therefore consist to an extent of around 95 wt % of cryolite ($Na_3AlF_6$).

In each case, one piece of cryolite crust was covered with a defined amount of solvent in a glass container. With gentle stirring (250 revolutions/min) and at the temperature reported in table 1 below, a determination was then made of the time taken for the crust to completely dissolve/disperse, initially using the naked eye. The solvent together with apparently dissolved/dispersed crust was transferred after the time reported in table 1 (requisite dissolution time), into a centrifuge tube. After around an hour, the cylinder tip of the centrifuge tube was observed to determine whether a sediment has formed. With regard to the results in table 1, no sediment was measured for the reported soluble amount of crust and requisite dissolution time.

TABLE 1

| Solvent (wt %) | Temp. (° C.) | Requisite dissolution time (min) | Soluble amount of crust (g/100 g solvent) |
|---|---|---|---|
| 15% HCl | 20 | 150 | 1 |
| 20% $H_2SO_4$ | 20 | 75 | 1 |
| 20% $H_2SO_4$ | 60 | ca. 20 | 1-2 |
| 15% NaOH/ complexing agents | 80 | >100 | 1-2 |
| 45% NaOH | 65 | >150 | 1-2 |
| 20% $AlCl_3$ | 20 | 220 | 1-2 |
| 20% $AlCl_3$ | 70 | 50 | 3 |
| 15% $NH_2HSO_3$ | 60 | >300 | 1 |
| 20% $H_2SO_4$/ 5% $B_2O_3$ | 60 | 25 | 5-6 |
| 20% $H_2SO_4$/ 9.9% adipic acid | 60 | 20 | 1-2 |
| 20% $H_2SO_4$/ 9% glutaric acid | 60 | 35 | 5-6 |
| 20% $H_2SO_4$/ 1% oxalic acid | 60 | 25 | 5-6 |
| 20% $H_2SO_4$/ 14% oxalic acid | 60 | 35 | 5-6 |
| 20% $H_2SO_4$/ 11% oxalic acid | 60 | 20 | 5-6 |
| 20% $H_2SO_4$/ 6% oxalic acid | 60 | 20 | 5-6 |

The results compiled in the table show that with use of solvents based on hydrochloric acid, sulfuric acid, sodium hydroxide with or without complexing agents and in various concentrations, aluminum chloride, and amidosulfuric acid with the exception of sulfuric acid at 60° C. and of the sulfuric acid/boric acid combination relatively long dissolution times are required before the complete dissolution/dispersal of the crusts.

Conversely, when using the method of the invention, the requisite dissolution time is comparatively short. Particularly striking, however, is that the amount of cryolitic deposit taken up by 100 g of solvent when applying the method of the invention is significantly higher than when using the other solvents with the exception of the sulfuric acid/boric acid combination.

Measured against the majority of the comparative tests (borate-free variants), the amount dissolved is greater by a factor of 4 to 6, with the consequence of a considerable saving on solvent. The amount dissolved when using the method of the invention is comparable with the amount dissolved with the sulfuric acid/boric acid combination.

Adipic acid is not soluble in 20% sulfuric acid and is therefore unable to act as a complexing agent for $Al^{3+}$. The results are therefore the same as with 20% sulfuric acid alone. Consequently, the soluble amount of crust is significantly lower here as well than in the case of the sulfuric acid/boric acid combination.

Glutaric acid, on the other hand, is soluble in 20% sulfuric acid although the dissolution procedure may take up to 30 minutes. Correspondingly, the soluble amount of crust here is already comparable with that for the sulfuric acid/boric acid combination.

The best results in terms of the requisite dissolution time are achievable with 6% and 11% oxalic acid (in combination with 20% sulfuric acid). The use of 6% oxalic acid, however, also has the advantage that there is less sediment present after cooling than in the case of 11% oxalic acid.

The invention claimed is:

1. An aqueous composition for removing cryolitic deposits from plants or parts of plants serving for the conversion treatment of metal surfaces, which composition comprises a) at least one mineral acid having a total normal concentration in the range from 3.0 to 10 mol/l; and b) at least one dicarboxylic acid of the formula HOOC—$(CH_2)_x$—COOH;

wherein x is 0 to 3 and no borate-containing compounds have been added to the composition.

2. The aqueous composition according to claim 1, which comprises b) at least one dicarboxylic acid of the formula HOOC—$(CH_2)_x$—COOH having a total concentration in the range from 0.07 to 1.7 mol/l.

3. The aqueous composition according to claim 1, which comprises the at least one mineral acid and the at least one dicarboxylic acid in a molar ratio in the range from 2.4:1 to 60:1.

4. The aqueous composition according to claim 1, wherein the at least one mineral acid comprises sulfuric acid.

5. The aqueous composition according to claim 4, which further comprises nitrate.

6. The aqueous composition according to claim 1, wherein the at least one dicarboxylic acid comprises malonic acid and/or oxalic acid.

7. The aqueous composition according to claim 4, which composition comprises a) sulfuric acid having a total normal concentration in the range from 3.0 to 6.0 mol/l, and b) oxalic acid having a total concentration in the range from 0.35 to 1.0 mol/l, and comprises the sulfuric acid and the oxalic acid in a molar ratio in the range from 4.0:1 to 12:1.

8. The aqueous composition according to claim 1, which additionally comprises at least one nonionic surfactant.

9. The aqueous composition according to claim 1, which additionally comprises at least one corrosion inhibitor.

10. The aqueous composition according to claim 9, wherein the at least one corrosion inhibitor is a mixture of a compound of the formula I $$R^1O—(CH_2)_x—C{\equiv}C—(CH_2)_y—OR^2 \quad (I),$$

in which $R^1$ and $R^2$ are both H, and a compound of the formula I in which $R^1$ and $R^2$ each independently of one another are an HO—$(CH_2)_w$ group with $w \geq 2$, wherein for each of the two compounds of the formula I, x and y in each case independently of one another are 1 to 4.

11. A concentrate from which, by dilution with a suitable solvent and/or dispersion medium, an aqueous composition according to claim 1 is obtainable.

12. A method for removing cryolitic deposits from plants or parts of plants serving for the conversion treatment of metal surfaces, which comprises contacting the plants and/or parts of plants with an aqueous composition according to claim 1.

13. The method according to claim 12, wherein the aqueous composition has a temperature in the range from 40 to 80° C.

14. The aqueous composition according to claim 1, which comprises a) at least one mineral acid having a total normal concentration in the range from 3.0 to 6 mol/l, and b) at least one dicarboxylic acid of the formula HOOC—$(CH_2)_x$—COOH having a total concentration in the range from 0.35 to 1.5 mol/l.

15. The aqueous composition according to claim 1, which comprises the at least one mineral acid and the at least one dicarboxylic acid in a molar ratio in the range from 2.6:1 to 12:1.

16. The aqueous composition according to claim 1, wherein the at least one dicarboxylic acid comprises oxalic acid.

17. The aqueous composition according to claim 4, which composition comprises a) sulfuric acid having a total normal concentration in the range from 3.5 to 4.5 mol/l, and b) oxalic acid having a total concentration in the range from 0.5 to 0.8 mol/l, and comprises the sulfuric acid and the oxalic acid in a molar ratio in the range from 5.0:1 to 8.0:1.

18. The aqueous composition according to claim 1, which additionally comprises at least one nonionic surfactant selected from the group consisting of ethoxylated fatty alcohol polyglycol ethers.

19. The aqueous composition according to claim 1, which additionally comprises at least one compound selected from the group consisting of urea derivatives, diols, and alkoxylated diols.

20. The method according to claim 12, wherein the aqueous composition has a temperature in the range from 50 to 70° C.

* * * * *